US006495093B2

(12) United States Patent
Kerschbaum et al.

(10) Patent No.: US 6,495,093 B2
(45) Date of Patent: Dec. 17, 2002

(54) DEVICE FOR CLOSING A TAP HOLE OF A METALLURGICAL VESSEL

(75) Inventors: Helmut Kerschbaum, Neuzeug (AT); Ernst Höllwarth, Neuzeug (AT); Albert Paster, Niederkappel (AT)

(73) Assignee: Voest-Alpine Industrieanlagenbau GmbH & Co (AT)

( * ) Notice: Subject to any disclaimer, the term of this patent is extended or adjusted under 35 U.S.C. 154(b) by 0 days.

(21) Appl. No.: 09/771,871

(22) Filed: Jan. 29, 2001

(65) Prior Publication Data

US 2001/0019188 A1 Sep. 6, 2001

(30) Foreign Application Priority Data

Jan. 27, 2000 (AT) ..... A 126/00

(51) Int. Cl.[7] ..... C21C 5/48
(52) U.S. Cl. ..... 266/272; 222/590; 222/597
(58) Field of Search ..... 266/45, 272; 222/590, 222/597, 603

(56) References Cited

U.S. PATENT DOCUMENTS 4,079,918 A * 3/1978 Truppe et al. ..... 266/272
4,232,855 A * 11/1980 Hartl ..... 266/272
4,261,554 A * 4/1981 Eysn ..... 266/272
4,781,357 A * 11/1988 Hartley et al. ..... 266/272

FOREIGN PATENT DOCUMENTS

EP 0010535 * 4/1980

* cited by examiner

*Primary Examiner*—Scott Kastler
(74) *Attorney, Agent, or Firm*—Ostrolenk, Faber, Gerb & Soffen, LLP

(57) ABSTRACT

The invention relates to a device for closing a tap hole of a metallurgical vessel, in particular a converter, for the purpose of separating a molten metal and slag, having a slag stopper 1, which is situated outside the vessel, which provides an actuable closure element 8 that can be inserted into a tap hole, leaving an annular gap relative to the wall of the tap hole, and which provides a number of lines, in particular a pressurized-gas line 10 intended for the supply of the closure element, the slag stopper 1 comprising a connecting frame 2, which carries and fixes the parts of the slag stopper, this connecting frame, for its part, being secured releasably at a connecting point 11 on the metallurgical vessel 12. This allows a significant reduction in the time required for servicing or changing the slag stopper.

19 Claims, 4 Drawing Sheets

DEVICE FOR CLOSING A TAP HOLE OF A METALLURGICAL VESSEL

Device for closing a tap hole of a metallurgical vessel, in particular a converter, for the purpose of separating a molten metal and slag, having a slag stopper, which is situated outside the vessel, which provides an actuable closure element that can be inserted into a tap hole, leaving an annular gap relative to the wall of the tap hole, and which provides a number of lines, in particular a pressurized-gas line intended for the supply of the closure element.

In the course of commercial development, the system requirements associated with a steel plant have focused increasingly on durability. This development is driven primarily by the enormous progress made in the area of materials technology. A second area on which attention has been concentrated is that of logistics as it relates to internal operations, which has been subject to intense monitoring and optimization. Maintenance and repair work on so-called wearing components, in particular, should have as little effect as possible on the flow of production during operation.

One wearing component of particular importance in steel production is the so-called slag stopper, which is intended to separate metal and slag as the material is poured out of a metallurgical vessel, and is known in the prior art from EP 0010535 A. While the life of a slag stopper was approximately the same as that of a converter, it was possible to remove the slag stopper from the converter without losing too much operating time. However, now that the life of converters, especially the life of linings, has been considerably increased by the use of particularly suitable materials, it is necessary to service the slag stopper on the converter while it is in operation. Removing and servicing the slag stopper known in the prior art are involved and time-consuming.

The object on which the present invention is based is therefore to develop a device for closing a tap hole of a metallurgical vessel, in particular a converter, for the purpose of separating a molten metal and slag, having a slag stopper, which is situated outside the vessel, which provides an actuable closure element that can be inserted into a tap hole, leaving an annular gap relative to the wall of the tap hole, and which provides a number of lines, in particular a pressurized-gas line intended for the supply of the closure element, a device which can be replaced or serviced in a simple and time-saving manner on the converter.

According to the invention, this object is achieved by virtue of the fact that the slag stopper comprises a connecting frame, which carries and fixes the parts of the slag stopper, this connecting frame, for its part, being secured releasably at a connecting point on the metallurgical vessel.

By virtue of the fact that the slag stopper, which includes the closure element itself and a number of lines and means required for correct operation, is fixed on a supporting frame or housing, all the important wearing parts can be replaced simply and with the minimum expenditure of time by replacing the frame or housing with all the parts attached to it, i.e. by replacing one system component. In a particularly advantageous refinement of the invention, all the lines required for the operation of the slag stopper are included in it and are thus also attached to the frame or housing.

According to another feature of the invention, the connecting frame has a, preferably flat, fixing part, by means of which the connecting frame is fixed at the connecting point on the metallurgical vessel.

According to a preferred exemplary embodiment of the subject-matter of the invention, a further, preferably flat, fixing part, in the simplest case a connection plate, is provided at the connection point on the metallurgical vessel, in particular the converter, this fixing part being used to fix the slag stopper on the metallurgical vessel. As well as being used to fix the slag stopper, this fixing part also serves to fix all important lines and connections required for operation of the slag stopper. For simplicity of mounting and removal, the fixing of the slag stopper on the metallurgical vessel is embodied in such a way that it will take a fitter about one hour to replace the slag stopper on the converter, allowing for any technical aids and assuming optimum conditions.

Suitable adjustment of the slag stopper at the connecting point on the metallurgical vessel is particularly important here, this being the only way of mounting it in such a short time. According to another feature of the subject-matter of the invention, this adjustment is accomplished by the formation of one or more hollow spigots on the connections of the lines of the slag stopper and by the formation of one or more sleeves on the connections of the lines at the connecting point on the metallurgical vessel or vice versa. In a preferred embodiment, the connections are each integrated into the fixing parts. According to one feature of the invention, O-rings, preferably made of copper, are used to seal the joints of the mutual connections.

To allow the slag stopper to be fixed releasably on the metallurgical vessel, in particular on the converter, use is preferably made of bolts and particularly preferably of so-called hammer-head bolts, which are distinguished by their ease of handling. One fixing part is advantageously fixed on the corresponding fixing part by means of the said fixing means.

A large number of ways both of adjusting and fixing the slag stopper on the converter apart from those mentioned are conceivable, one example being centring by means of suitable guide pins or similar devices.

According to one feature of the invention, the pressurized-gas line and the actuable closure element are connected to one another by a swivel joint. The swivel joint, preferably a suitably adapted "swivel rotary joint", is distinguished, on the one hand, by its flexibility plus a very small space requirement and high reliability.

BRIEF DESCRIPTION OF THE DRAWINGS

A nonlimitative embodiment of the invention will be described in greater detail below with reference to drawings, in which:

FIG. 1 shows a preferred embodiment of the subject-matter of the invention, the slag stopper having a connecting frame 2. The connecting frame 2 is fitted with a fixing part 3, which has a plurality of connections 4 and is fixed on the fixing part 9 of the connecting point 11 of the converter 12 by hammer-head bolts 5. In particular, the connections 4 are designed as hollow spigots and can thus be used for adjustment of the slag stopper at the connecting point 11, in particular on the fixing part 9 of the converter. To seal off the joints, the spigots are fitted with copper sealing rings, referred to as copper O-rings, for example. In FIG. 1, the slag stopper 1 is mounted on a replacement frame 6, which serves to facilitate the mounting of the slag stopper on and its removal from the metallurgical vessel.

This replacement frame 6 simplifies the process of moving the slag stopper immediately up to and away from the connecting point 11 on the converter.

Figure 3:
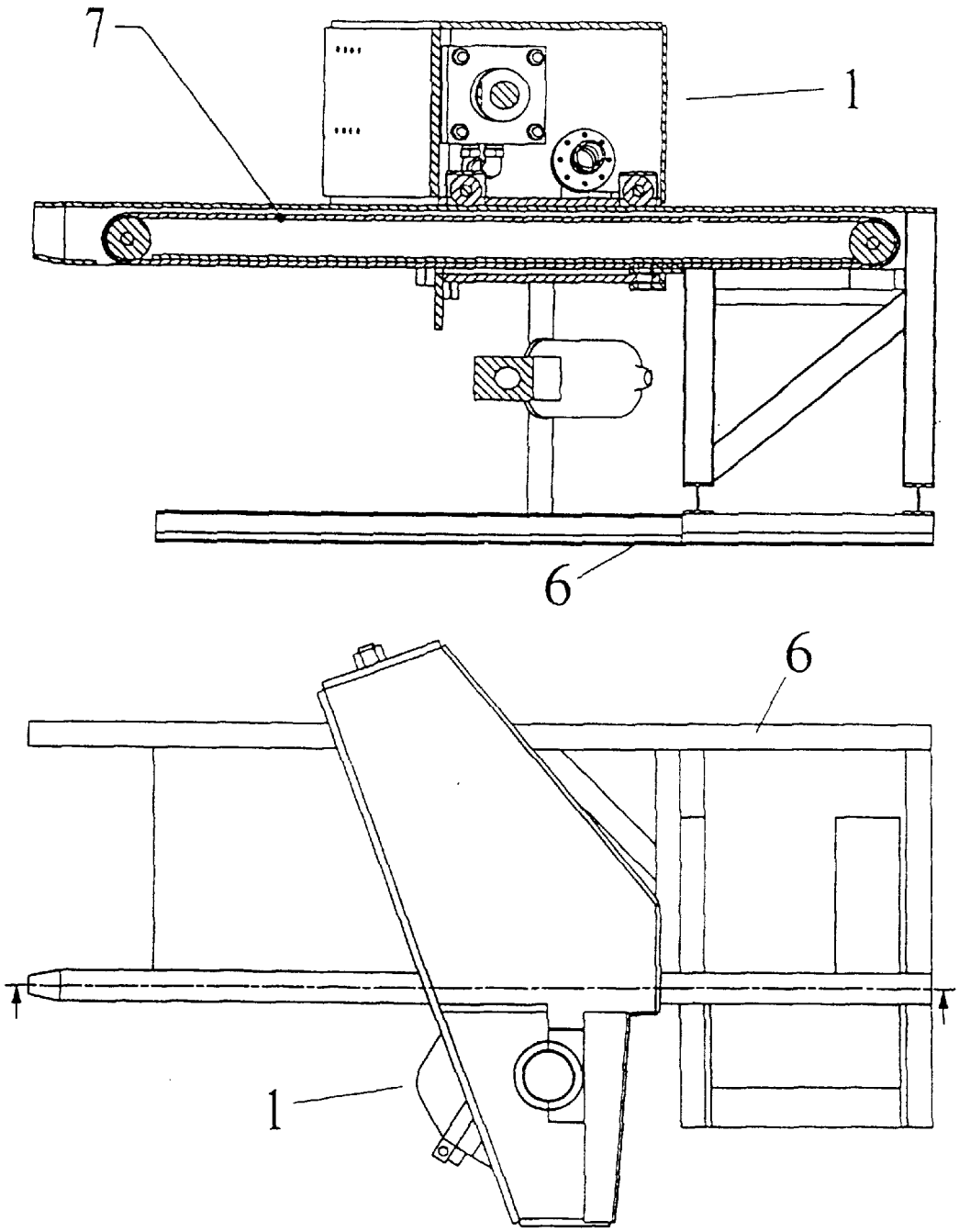
FIG. 3 shows schematically a preferred embodiment of a device for closing a tap hole of a metallurgical vessel, on a replacement frame.
Figure 4:
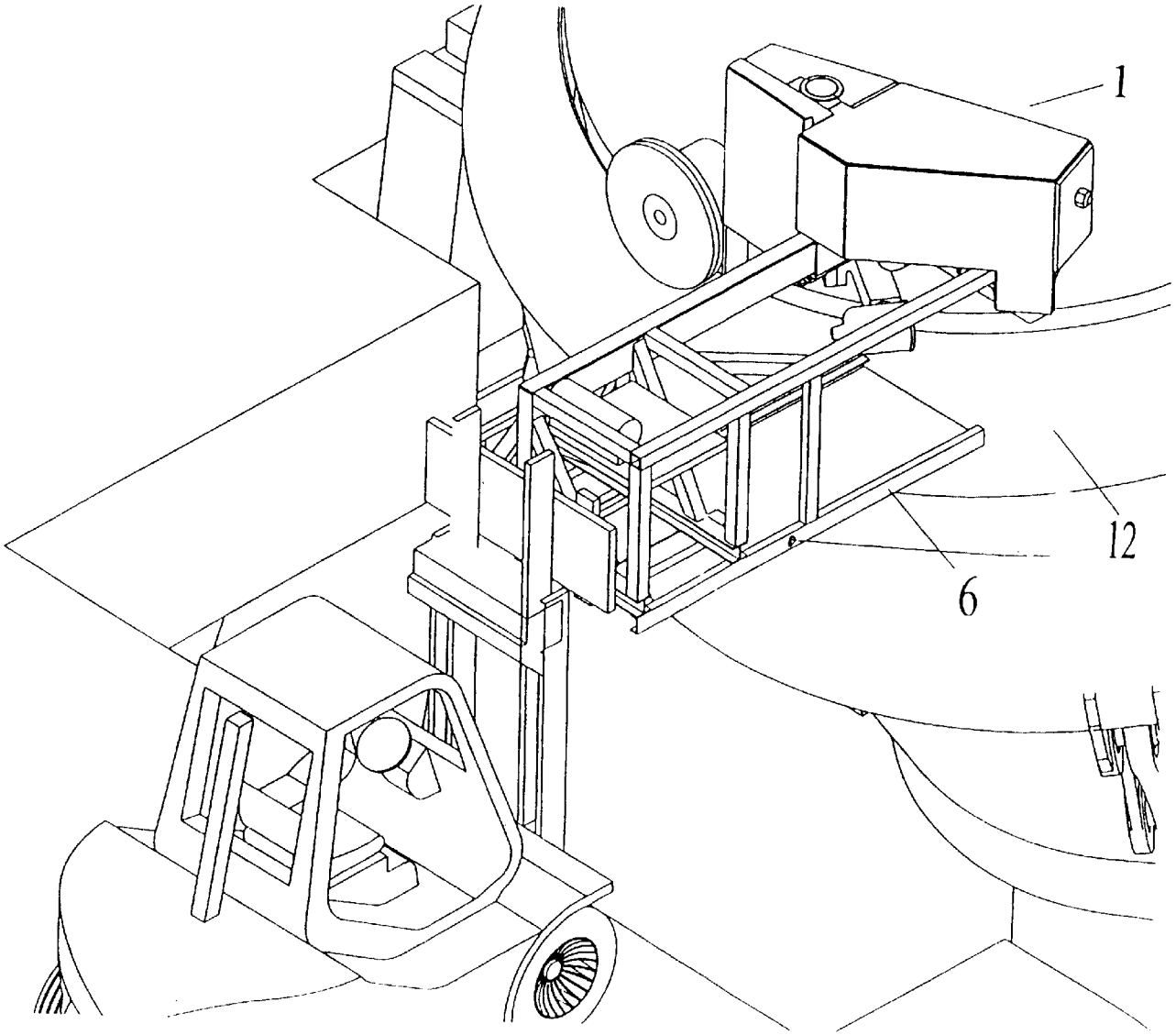
FIG. 4 shows schematically the fitting of a preferred embodiment of a device for closing a tap hole of a metallurgical vessel.

FIG. 3 gives a more detailed view of a preferred embodiment of a replacement frame of this kind, with the slag stopper 1 in this case being moved on the replacement frame 6 by means of a suitable transportation means, here a chain drive 7 and one or two driving features (not shown). The replacement frame itself is moved into a suitable position for mounting and removing the slag stopper by means of a fork-lift truck, for example, as illustrated in FIG. 4.

Figure 1:
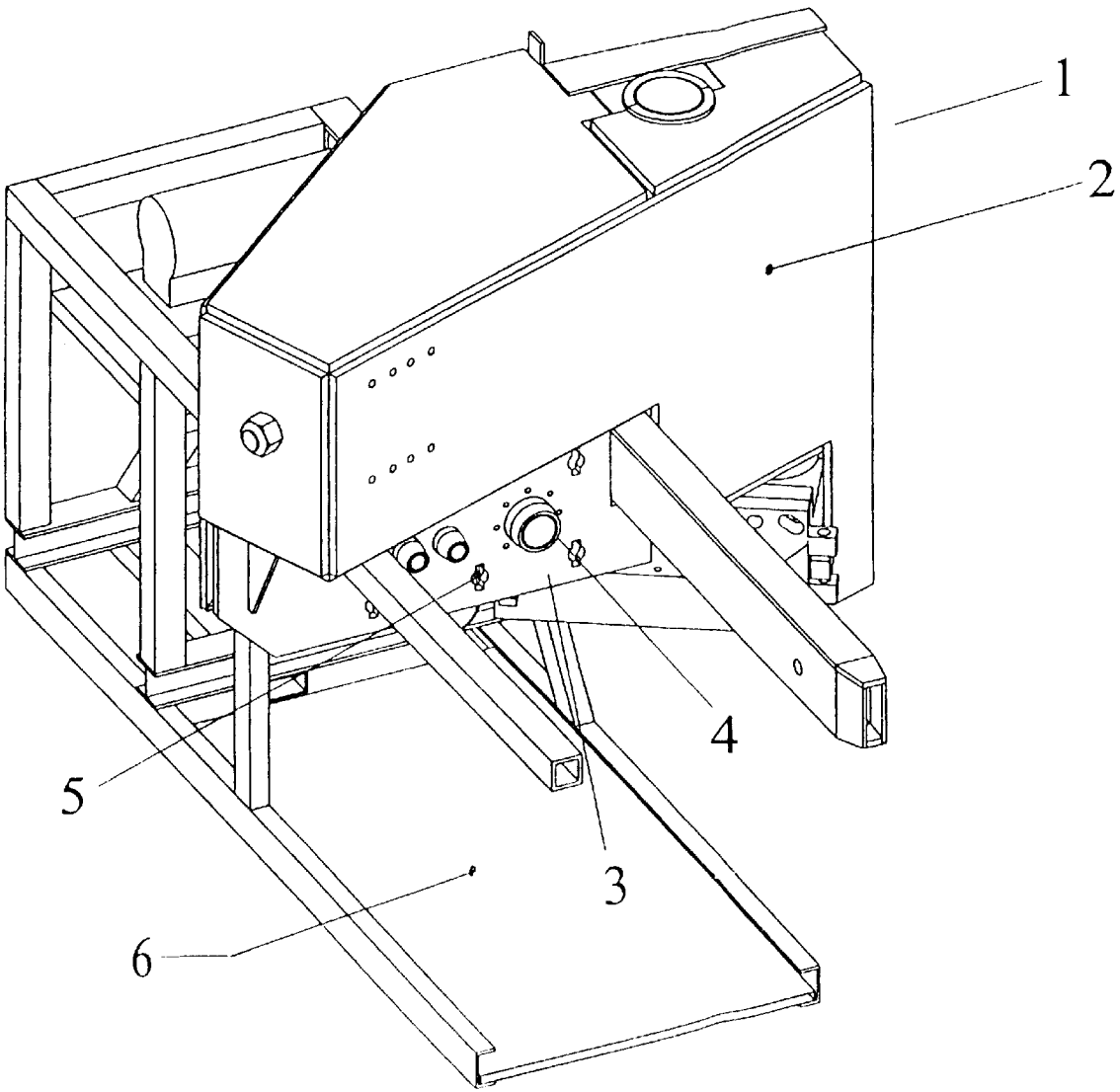
FIG. 1 shows schematically a preferred embodiment of the subject-matter of the invention on a replacement frame that serves to facilitate the mounting of the slag stopper on and its removal from the metallurgical vessel.
Figure 2:
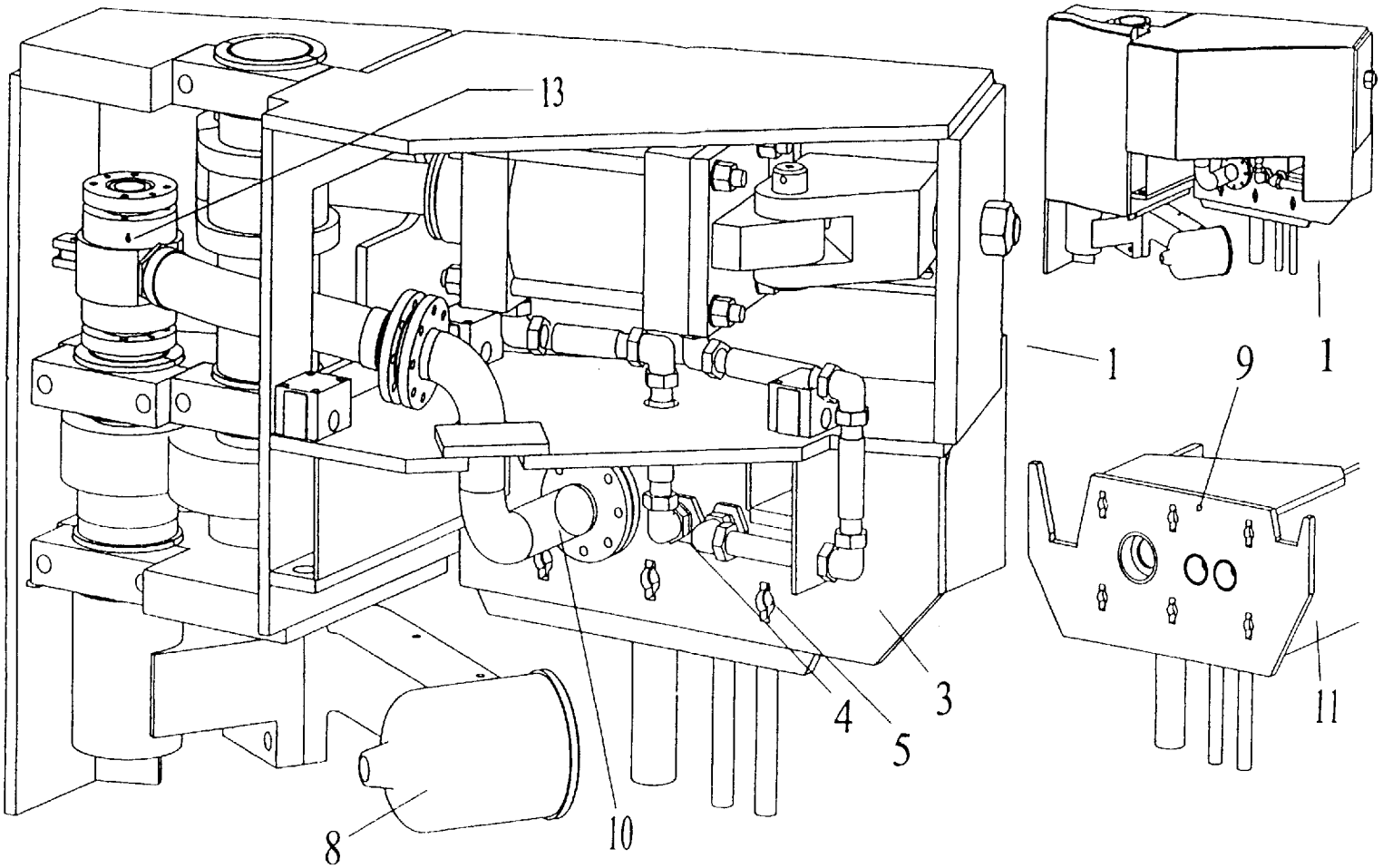
FIG. 2 shows schematically a preferred embodiment of the subject-matter, including a number of detail views.

As already mentioned, the slag stopper has a connecting frame 2 and can be seen in detail in FIG. 2, and as further important features it has a closure element 8 and a pressurized-gas line 10. This pressurized-gas line is connected to the actuable closure element 8 by a swivel joint 13. As can furthermore be seen in FIG. 2, the slag stopper is supplied via its connections 4, which are located on the flat fixing part 3. The counterpart to this fixing part 3, fixing part 9, is situated at the connecting point 11 on the converter 12 and has corresponding counterparts to the hollow spigots of the connections 4 of the slag stopper. The apertures created for a number of hammer-head bolts 5 provided for fixing the slag stopper 1 are again visible in FIG. 2.

If the need for maintenance to the slag stopper is recognized during operation, an operational slag stopper is prepared in the operating shop as a first step. During the travel of the converter, for example, the replacement frame 6 is now moved up to the converter 12 by means of a suitable transportation means, a fork-lift truck for instance, the hammer-head bolts 5 are undone, and the slag stopper 1 is moved carefully by a suitable conveying means, e.g. a chain drive 7 or a hydraulic drive, from a position on the converter into a parked position. In the meantime, the prepared slag stopper is moved up to the converter on a replacement frame, once again by a fork-lift truck for example, and brought into a mounted position on the converter 12 by actuation of a conveying means 7. Adjustment of the slag stopper 1 on the converter 12 is enabled by appropriate design of the connections 4 of the slag stopper 1 and the connecting point 11 on the converter. Finally, the joints between the connections on the slag stopper and the corresponding connections on the converter 12 or connecting point on the converter are fixed and sealed by means of hammer-head bolts 5 and sealing means, e.g. O-rings.

Exchange of the slag stopper to be serviced is thus complete and expert servicing can be carried out in a workshop.

What is claimed is:

1. A device for closing a tap hole of a metallurgical vessel comprising:

a supporting frame that is releasably connectable to a metallurgical vessel, the supporting frame including a first connecting portion that is engageable with a complementary second connecting portion on the metallurgical vessel when the frame and the metallurgical vessel are connected;

a releasable latching mechanism that is operative to connect the metallurgical vessel and the frame;

a releasable conduit coupler including a first coupling part on the first connecting portion that is sealingly engageable with a second coupling part on the second connecting portion;

a pneumatic closure element for the tap hole mounted on the supporting frame, the closure element being movable relative to the supporting frame, when the supporting frame and the metallurgical vessel are connected, between a position outside the tap hole and a position in the tap hole, leaving an annular gap relative to the margin of the tap hole;

the closure element having an outlet for delivering pressurized gas into the annular gap;

a pressurized-gas conduit mounted on the supporting frame, the pressurized-gas conduit having a first end attached to the first coupling part, and a second end attached to the closure element so that pressurized gas deliverable through the second coupling part can flow through the pressurized-gas conduit to the outlet in the closure element;

the supporting frame being removably mountable on a carriage that is transportable to and away from the metallurgical vessel, the supporting frame being movable relative to the carriage between a first position at which the frame is not in connectable with the metallurgical vessel, and a second position at which the frame is connectable to the metallurgical vessel.

2. A device according to claim 1, wherein the latching mechanism is comprised of a plurality of hammer-head bolts which engage between the first and second connecting portions.

3. A device according to claim 1, wherein the conduit coupler is comprised of a tubular element projecting from one of the connecting portions, and configured to be received in a sleeve on the other connecting portion.

4. A device according to claim 3, further including a copper o-ring positioned to seal the joint between the projecting tubular element and the sleeve.

5. A device according to claim 1, wherein the second end of the pressurized-gas conduit is connected to the closure element by a swivel joint.

6. A device according to claim 1, including:

a plurality of further releasable conduit couplers, each including a first coupling part on the first connecting portion that is sealingly engageable with a second coupling part on the second connecting portion; and a plurality of further conduits on the supporting frame, respectively connected at one end to a first coupling part of one of further conduit couplers, and respectively connected at another end to one of a plurality of functional elements on the supporting frame.

7. A device according to claim 6, wherein each of the further conduit couplers is comprised of a tubular element projecting from one of the connecting portions, and configured to be received in a sleeve on the other connecting portion.

8. A device according to claim 7, further including a plurality of copper o-rings respectively positioned to seal the joints between the projecting tubular elements of the further conduit couplers and the associated sleeves.

9. A metallurgical apparatus comprising:

metallurgical vessel including a tap hole;

a slag stopper, the slag stopper being comprised of:

a supporting frame;

a releasable latching mechanism that connects the supporting frame to the metallurgical vessel and allows the supporting frame to be disconnected from the metallurgical vessel when the slag stopper requires service;

a first connecting portion on the supporting frame that engages with a complementary second connecting portion on the metallurgical vessel when the supporting frame and the metallurgical vessel are connected;

a releasable conduit coupler including a first coupling part on the first connecting portion and a second coupling part on the second connecting portion, the coupling parts being sealingly coupled when the first and second connecting portions are engaged;

a pneumatic closure element for the tap hole mounted on the supporting frame, the closure element being movable relative to the supporting frame between a position outside the tap hole and a position in the tap hole, leaving an annular gap relative to the margin of the tap hole;

an outlet in the closure element for delivering pressurized gas into the annular gap; and a pressurized-gas conduit mounted on the supporting frame, the pressurized-gas conduit having a first end attached to the first coupling part, and a second end connected to the closure element to communicate with the outlet therein;

the second coupling part being connectable to a pressurized gas supply from which pressurized gas can be provided through the coupler and the pressurized-gas conduit to the outlet in the closure element;

a carriage that is transportable to and away from the metallurgical vessel, the supporting frame being removably mountable on the carriage; and a mechanism on the carriage operable, when the supporting frame is mounted on the carriage, to move the supporting frame relative to the carriage to bring the first and second connecting portions into and out of contact with each other, the supporting frame being separable from the carriage when it is connected to the metallurgical vessel.

10. A device according to claim 9, including:

a plurality of further releasable conduit couplers, each including a first coupling part on the first connecting portion that is sealingly engageable with a second coupling part on the second connecting portion; and a plurality of further conduits on the supporting frame, respectively connected at one end to a second coupling part of one of further conduit couplers, and respectively connected at another end to one of a plurality of functional elements on the supporting frame.

11. A device according to claim 10, wherein each of the further conduit couplers is comprised of a tubular element projecting from one of the connecting portions, and configured to be received in a sleeve on the other connecting portion.

12. A device according to claim 11, further including a plurality of copper o-rings respectively positioned to seal the joints between the projecting tubular elements of the further conduit couplers and the associated sleeves.

13. A device according to claim 9, wherein the second end of the pressurized-gas conduit is connected to the closure element by a swivel joint.

14. A method of operating a metallurgical vessel that employs a slag stopper including a pneumatic closure element for a tap hole in the vessel, the closure element being movable between a position outside the tap hole and a position in the tap hole, leaving an annular gap relative to the margin of the tap hole, the closure element having an outlet therein for delivering pressurized gas into the annular gap, the method comprising the steps of:

mounting the closure element and a pressurized-gas conduit on a supporting frame;

providing a conduit coupler including a first coupling part on the supporting frame and a second coupling part on the metallurgical vessel that is sealingly engageable with the first coupling part;

connecting one end of the pressurized-gas conduit to the first coupling part;

connecting a second end of the pressurized-gas conduit to the closure element to communicate with the outlet therein;

connecting the second coupling part to a pressurized gas supply from which pressurized gas can be provided through the first and second coupling parts and the pressurized-gas conduit to the outlet in the closure element;

transporting the supporting frame on a carriage from a location remote from the metallurgical vessel to a position adjacent to the metallurgical vessel, the supporting frame being removably mountable on the carriage;

moving the supporting frame on the carriage to bring a first connecting portion of the supporting frame and a complementary second connecting portion on the metallurgical vessel into contact with each other so that the first and second coupling parts are sealingly engaged;

releasably latching the supporting frame to the metallurgical vessel; and separating the supporting frame and the carriage when the supporting frame is connected to the metallurgical vessel.

15. A method according to claim 14, in which, when the slag stopper requires servicing, further includes the steps of:

positioning a transportable carriage to receive the supporting frame;

operably engaging the supporting frame and the carriage;

unlatching the supporting frame from the metallurgical vessel;

moving the supporting frame on the carriage to separate the first and second connecting portions so that the first and second coupling parts are disengaged; and transporting the slag stopper requiring servicing on the carriage to a service location.

16. A method according to claim 15, further including the steps of:

delivering a replacement slag stopper to the vicinity of the metallurgical vessel on a further transportable carriage to replace a slag stopper requiring servicing; and connecting the replacement slag stopper to the metallurgical vessel after the slag stopper requiring servicing has been disconnected from the metallurgical vessel and transported away from the metallurgical vessel on the carriage to which it has been attached.

17. A method according to claim 14, further including the steps of:

providing a plurality of further conduit couplers, each including a first coupling part on the supporting frame that is releasably engageable with a second coupling part on the metallurgical vessel when the supporting frame and the metallurgical vessel are connected together; and providing a plurality of further conduits on the supporting frame, respectively connected at one end to a first coupling part of one of further conduit couplers, and respectively connected at another end to one of a plurality of functional elements on the supporting frame.

18. A method according to claim 17, in which, when the slag stopper requires servicing, further includes the steps of:

positioning a transportable carriage to receive the supporting frame;

operably engaging the supporting frame and the carriage;

unlatching the supporting frame from the metallurgical vessel;

moving the supporting frame on the carriage to separate the first and second connecting portions so that the first and second coupling parts are disengaged; and transporting the supporting frame on the carriage to a location remote from the metallurgical vessel for servicing.

19. A device according to claim 14, wherein the first end of the pressurized-gas conduit is connected to the closure element by a swivel joint.

* * * * *